US006032838A

United States Patent [19]

Maher

[11] Patent Number: 6,032,838

[45] Date of Patent: Mar. 7, 2000

[54] APPARATUS FOR DISPLAYING INFORMATION RELATED TO THE WEIGHT OF AN ARTICLE OF CLOTHING

[75] Inventor: Liam Maher, Bristol, Vt.

[73] Assignee: The Burton Corporation, Burlington, Vt.

[21] Appl. No.: 09/005,653

[22] Filed: Jan. 12, 1998

[51] Int. Cl.[7] ..... A47G 25/14

[52] U.S. Cl. ..... 223/85; 223/92; 177/264

[58] Field of Search ..... 223/85, 88, 92, 223/95; 40/458; 177/264, 148, 149, 168, 169

[56] References Cited

U.S. PATENT DOCUMENTS

| | | | |
|---|---|---|---|
| 1,183,428 | 5/1916 | Burns | 177/148 |
| 1,338,220 | 4/1920 | Gillarde | 177/168 |
| 1,530,857 | 3/1925 | Settle | 223/85 |
| 4,799,560 | 1/1989 | Kobayashi | 177/148 |
| 4,936,399 | 6/1990 | Christman et al. | 177/148 |
| 5,576,521 | 11/1996 | Dubach | 177/148 |

FOREIGN PATENT DOCUMENTS

| | | | |
|---|---|---|---|
| 1267739 | 9/1960 | France | 177/148 |
| 87535 | 11/1895 | Germany | 177/148 |

*Primary Examiner*—Bibhu Mohanty
*Attorney, Agent, or Firm*—Wolf, Greenfield, & Sacks, P.C.

[57] ABSTRACT

An apparatus for displaying information related to the weight of an article of clothing including a hanger-shaped frame and a scale for measuring the weight of an article of clothing disposed on the frame is disclosed. The apparatus may preferably include a visual indicator, such as a pointer and indicia, for displaying information to a viewer relating to the weight of the article of clothing, as desired. The scale may preferably be disposed within the frame and may be functionally connected to the frame such that the pointer moves within a slot in the frame as the scale measures the weight of the article of clothing. The indicia may be provided adjacent the slot to provide the viewer with visual information relating to the weight of the clothing as the pointer moves. In one embodiment, the scale may be calibrated within a predetermined range of weights where the indicia reflects more favorable attributes for a lighter range of clothing. For example, the indicia may include an arrow pointing toward the lowest weight on the scale to display to a viewer the light weightedness of the article of clothing and may list positive attributes associated with the lighter weight clothing.

26 Claims, 4 Drawing Sheets

APPARATUS FOR DISPLAYING INFORMATION RELATED TO THE WEIGHT OF AN ARTICLE OF CLOTHING

DESCRIPTION

1. Technical Field

The present application relates to an apparatus for displaying information related to the weight of an article of clothing.

2. Background of Related Art

Clothing is often displayed and/or stored on hangers by retailers. Hangers are generally designed to hold a single piece of clothing, such as a shirt, pants or a jacket and may be specifically designed according to the article of clothing they are intended to hold. Regardless of the article of clothing, hangers generally include a frame or body for supporting the clothing and a hanging mechanism, such as hook, to suspend the body from a support member, such as a clothing rack. In addition, clothing may be displayed on merchandising hangers during trade shows and the like. Such merchandising hangers may, additionally, include information for the customer, such as the style of clothing and the name of the manufacturer.

SUMMARY

In accordance with the present invention, there is provided an apparatus for displaying information related to the weight of an article of clothing including a hanger-shaped frame and a scale for measuring the weight of an article of clothing disposed on the frame. The apparatus may also preferably include a visual indicator, such as a pointer and indicia, for displaying information to a viewer relating to the weight of the article of clothing, as desired. The scale may preferably be disposed within the frame and may be functionally connected to the frame such that the pointer moves within a slot in the frame as the scale measures the weight of the article of clothing. Indicia may be provided adjacent the slot to provide the viewer with visual information relating to the weight of the clothing as the pointer moves. In one embodiment, the scale may be calibrated within a predetermined range of weights where the indicia reflects more favorable attributes for a lighter range of clothing. For example, the indicia may include an arrow pointing toward the lowest weight on the scale to display to a viewer the light weightedness of the article of clothing and may list positive attributes associated with the lighter weight clothing.

In one embodiment, the scale includes a rod extending from a hanging mechanism, such as a hook, at least one compression spring disposed about the rod, an adjustable nut secured at a second end of the rod and configured to retain the spring about the rod and to adjust the calibration of the scale by varying the tension of the spring, and a lock nut for securing a first end of a wire between the adjustable nut and the lock nut. A second end of the wire may be connected to a first end of the pointer, the second end of the pointer preferably being visible through the slot in the frame of the hanger. The pointer may preferably be pivotally connected to the interior of the frame of the hanger between its first and second ends. In use, as the clothing is placed on the hanger, the weight of the article of clothing moves the frame of the hanger downward, against the force of the compression spring. As the frame moves downward and the spring is compressed, the first end of the pointer is moved by the rod such that the pointer is pivoted about its pivot point thereby moving the first end of the pointer within the slot and adjacent the indicia to provide the viewer with a visual indication relating to the weight of the clothing.

In one embodiment, the frame includes a pair of arms for engaging a jacket, such as a jacket utilized in the sport of snowboarding.

It is therefore an object of the present invention to provide an apparatus for displaying information related to the weight of an article of clothing disposed thereon.

It is another object of the present invention to provide an apparatus including a visual indicator including indicia that reflects more favorable attributes associated with a lighter range of clothing.

BRIEF DESCRIPTION OF THE DRAWINGS

Various embodiments are described herein with reference to the drawings, wherein.

DETAILED DESCRIPTION OF THE EMBODIMENTS

Figure 1:
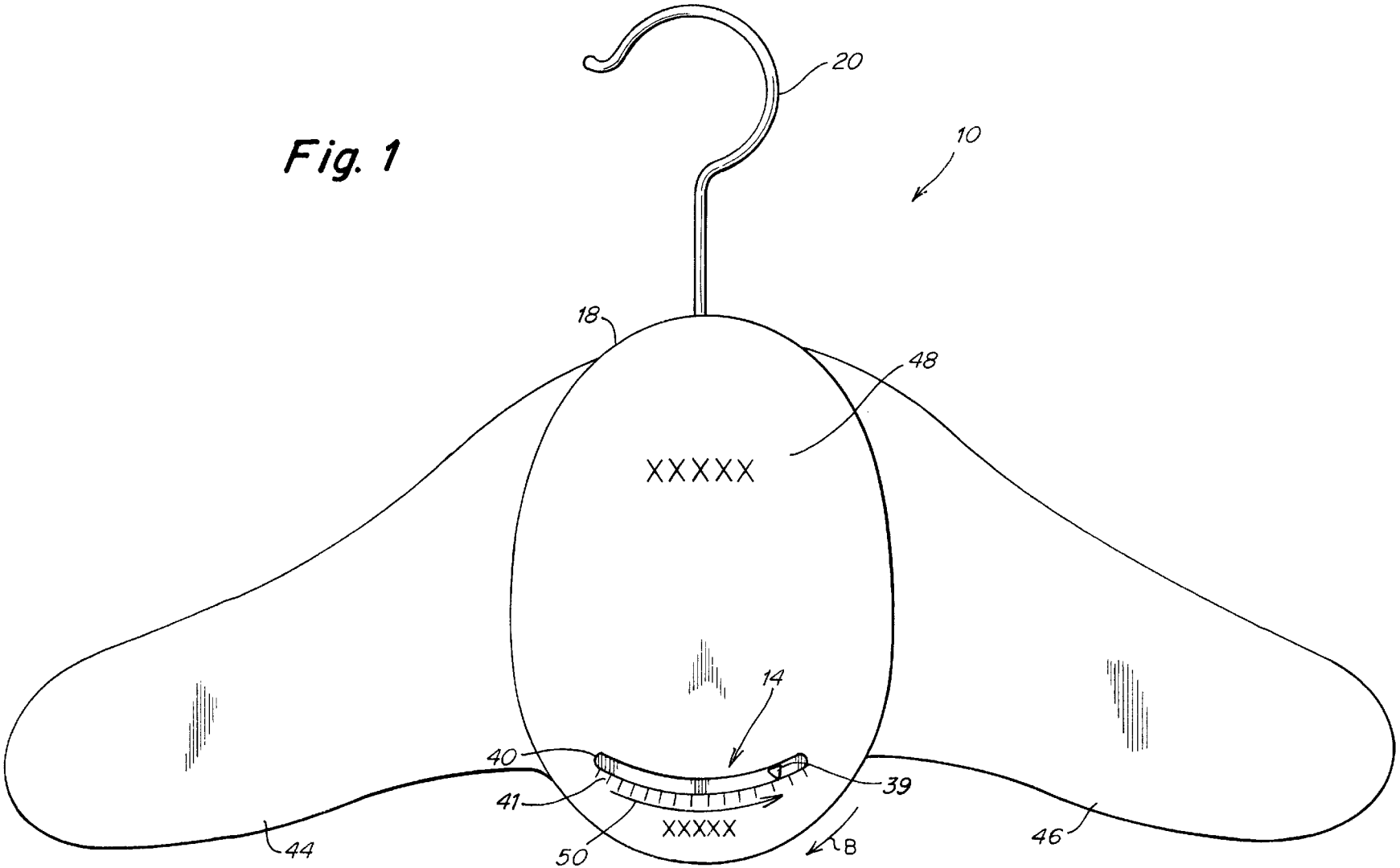
FIG. 1 is a front view of a hanger having a scale disposed therein according to the present invention.
Figure 2:
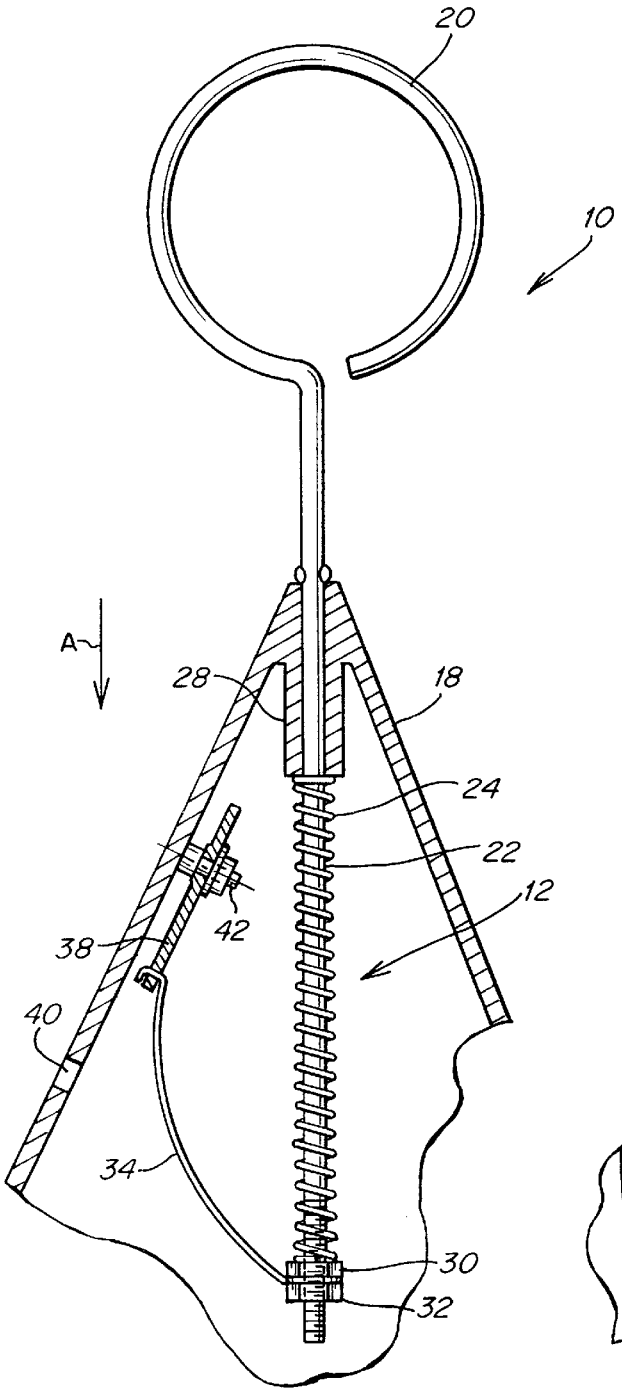
FIG. 2 is a schematic view of the scale of FIG. 1.

In one embodiment of the invention, shown in FIGS. 1–4, a hanger 10 is provided including a scale 12 (FIG. 2) for measuring the weight of an article of clothing supported on the hanger 10, and a visual indicator 14 for displaying information to a viewer relating to the weight of the article of clothing. Scale 12 may preferably include a support member, such as rod 22, extending from a hanging mechanism 20 configured to suspend or support frame hanger-shaped frame 18. For example, hanging mechanism 20 may be configured as a hook to suspend the frame from a rack, or the hanging mechanism may be configured as a pedestal with an extension to support the frame. At least one spring 24 is retained about rod 22, the spring 24 preferably being biased at one end against the interior of frame 18. In the present embodiment, spring 24 may preferably be a compression spring which is retained against a boss 28 by an adjustment member, or nut 30, as shown in FIG. 2. Nut 30 may be threaded about one end of rod 22, adjacent a second end of spring 24, and may be tightened or loosened to selectively adjust the calibration of the scale by adjusting the tension of the spring 24, as desired. Scale 12 may also include a locking nut 32 secured to a second end of rod 22, the locking nut operating to attach a connection wire 34 to the rod by retaining one end of the wire 34 between adjustment nut 30 and locking nut 32. Wire 34 may preferably be made of a semi-rigid material, such as 0.040" music wire, and may be connected at a second end to one end of pointer 38. Alternate materials and thicknesses may be utilized for wire 34, provided that the wire is semi-rigid so as to move pointer 38 when an article of clothing is disposed on the hanger, as described below.

Figure 3:
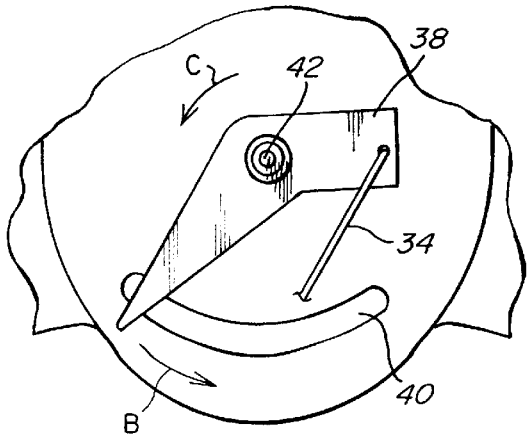
FIG. 3 is a schematic view of a pointer attached to the interior of the hanger of FIG. 1.

Pointer 38 preferably includes a second end which may be configured as an arrow 39 visible through a slot 40 formed in frame 18 of the hanger 10 (FIG. 1). As shown in FIG. 3, pointer 38 may preferably be pivotally connected to the interior of frame 18 at a pivot point 42 disposed between the first and second ends of the pointer. Alternately, the pointer may be supported by the scale 12. In use, as the weight of the clothing is measured by the scale, wire 34 pushes on the first end of pointer 38, causing the pointer to pivot about point 42 thereby moving arrow 39 within slot 40, as described below. Indicia 41 may also be provided adjacent slot 40 to give the viewer a visual indication relating to the weight of the clothing (FIG. 1).

Rod 22 may be formed of a rigid metal, such as steel with a diameter of 0.170 inches, and may be formed as an extension of hanging mechanism 20. Alternately, other rigid or semi-rigid materials of varying dimensions may be utilized to form rod 22 and the rod may be formed as a separate member attached to the hanging mechanism in any known manner. Likewise, boss 28 may be molded to the interior of the frame 18, but may alternately be attached to frame 18 in other ways, for ex. adhesive, as would be known to one of skill in the art. Frame 18 may be configured as a housing for supporting scale 12 therein. Alternately, the scale may be supported in any manner, provided that relative movement between the frame and support 22 for the spring is maintained.

Figure 4:
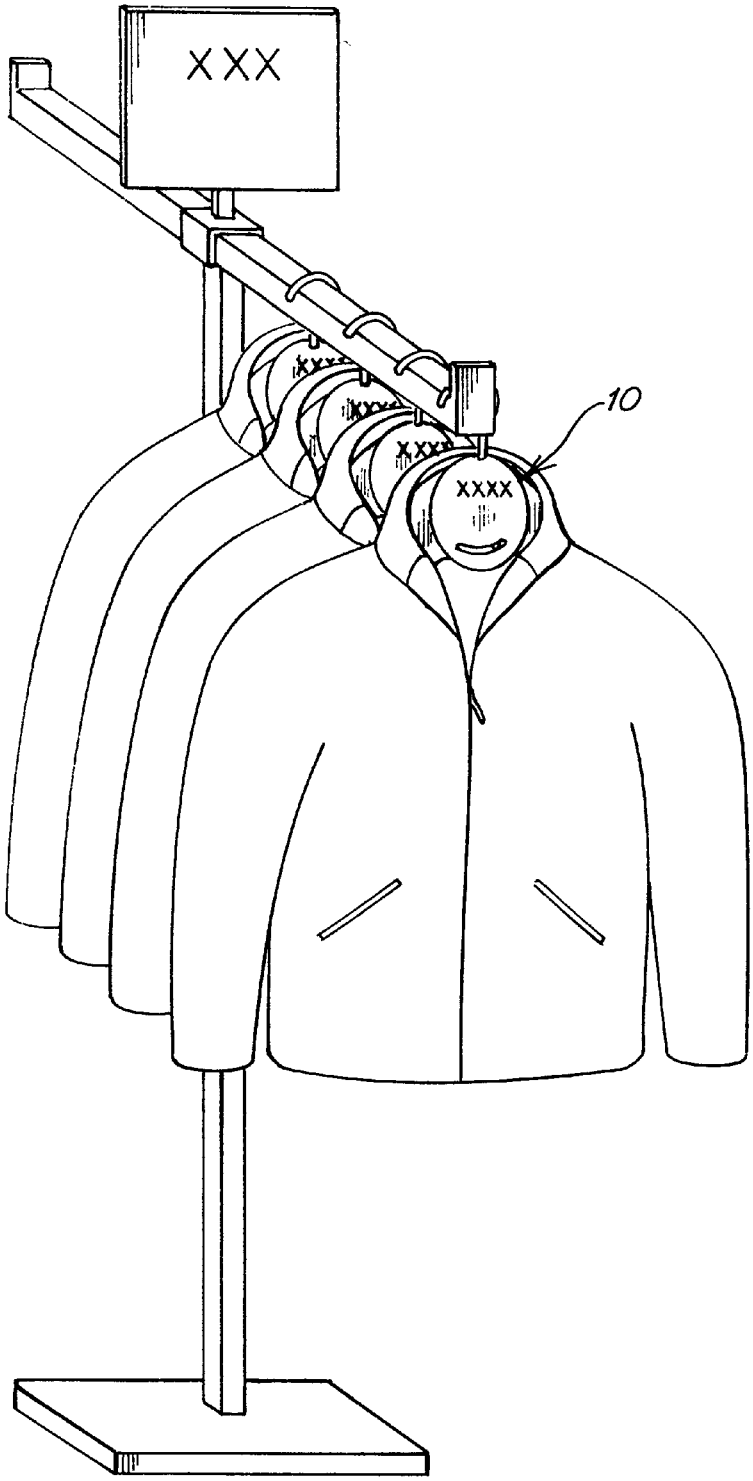
FIG. 4 is a perspective view of the hanger of FIG. 1 in use, with a jacket hung thereon.

As shown in FIG. 3, frame 18 is configured in the shape of a hanger and is arranged to hold a jacket, and may therefore include arms 44, 46 to retain the jacket over the frame, as is known in the art. Alternately, the frame may be configured to hold other types of clothing, for example the frame may include a rod supported by the hanging mechanism to hold a pair of pants, the frame may include clips to hold a skirt, or the like. As used herein, the term "hanger-shaped frame" refers to a conventional and commonly known garment hanger shape with a hook attached to a body portion, with two supporting arms extending outwardly therefrom shaped to support the shoulders of a garment. The frame may also include a display plate 48 carrying merchandising or other information. In the present embodiment, slot 40 and indicia 41 may preferably be included as part of display plate 48. Display plate 48 may preferably be disposed between arms 44, 46 so that the display plate remains visible after the jacket, or other article of clothing, is placed on the hanger, as shown in FIG. 4.

In one example of use, an article of clothing (such as a snowboard jacket) may be placed on the frame 18, the frame being suspended from a support member by hanging mechanism 20. As the clothing is placed on the frame, the weight of the article of clothing moves frame 18 downward, in the direction of arrow A, against the force of the compression spring 24. In the present embodiment spring 24 may preferably be a 3 inch long spring with a compression force of about 5 lbs per inch. Thus, a 5 pound weight supported by hanger 10 will compress the spring about one inch. For an average jacket having a weight of between 2–3 lbs, the spring would, therefore compress about ½ an inch. Alternately, the length of the spring and compression force may be varied, depending upon the particular application, as would be known to one of skill in the art.

As frame 18 moves downward and spring 24 is compressed, wire 34 pushes against the first end of pointer 38, such that the pointer is pivoted about point 42, in the direction of arrow "C" (FIG. 3). In the present embodiment, the second end of pointer 38 points to 0, or an alternate "at rest" measurement when no clothing is disposed on the frame. As the pointer 38 is pivoted, arrow 39 moves within slot 40, in the direction of arrow B and adjacent indicia 41 to provide the viewer with a visual indication relating to the weight of the clothing. In the present embodiment, the scale may be calibrated within a predetermined range of weights where the indicia reflects more favorable attributes for a lighter range of clothing. For example, the indicia may include an arrow 50 pointing toward the lowest weight on the scale to display to a viewer the light weightedness of the article of clothing and may include accompanying text that list positive attributes associated with the lighter weight clothing, for example in connection with snowboard related clothing, "More Air, More Times up Hill, More Performance". Slot 40 may be arcuate and may be configured according to the requirements of the article of clothing being measured. For example, when utilized with a snowboarding jacket having an average weight of 2–3 lbs, the length of the slot may be dimensioned such that the arrow will move approximately ¼ of an inch within the slot from the at rest position.

Figure 5:
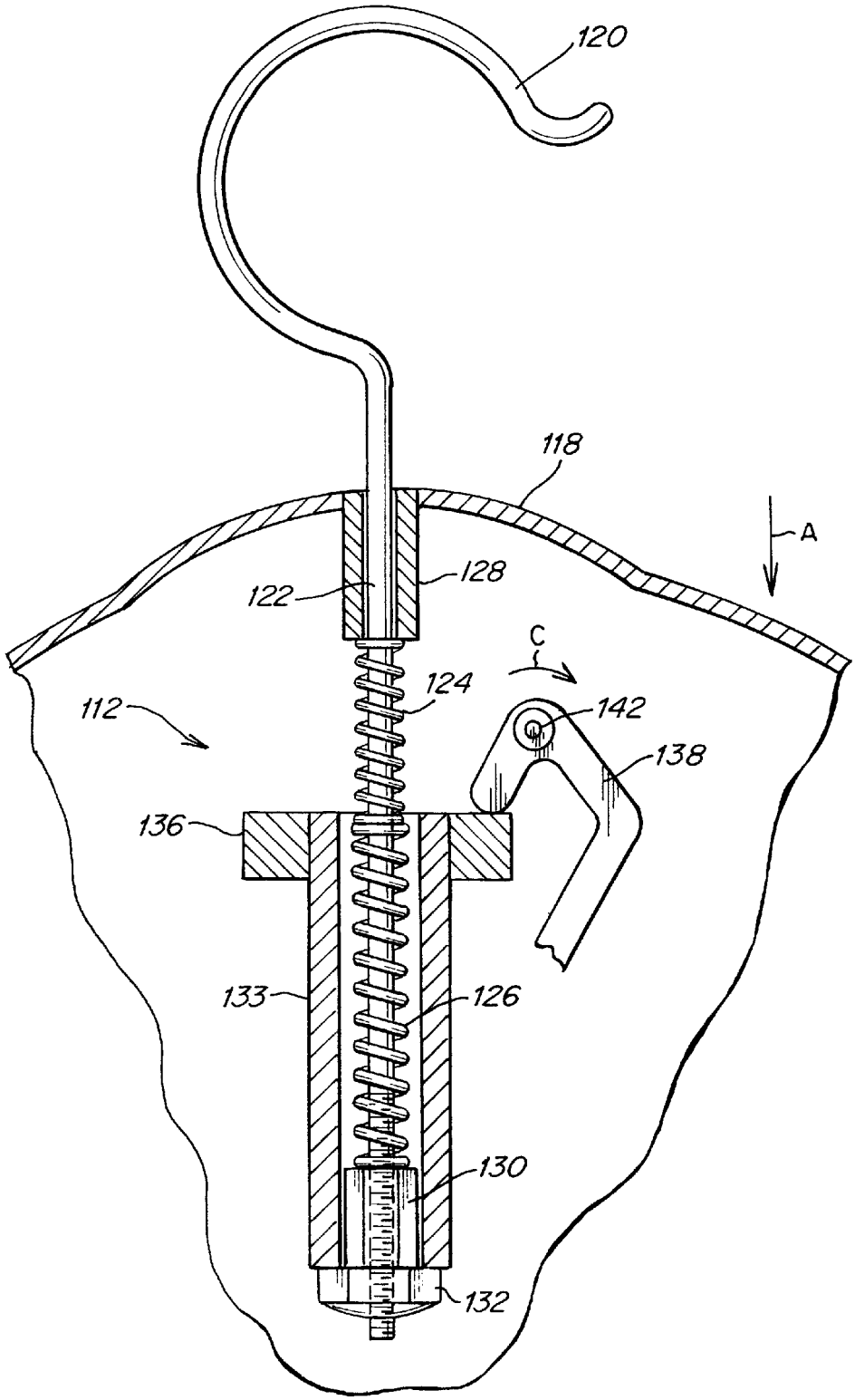
FIG. 5 is an alternate embodiment of the scale for use with the hanger.

The scale 12 may be any of a variety of weighing mechanisms and is, therefore, not limited to the scale shown and described with respect to FIGS. 1–4. For example, scale 112 (FIG. 5) may be utilized to weigh the article of clothing. As shown in FIG. 5, a pair of compression springs 124, 126 may preferably be disposed about rod 122 and may be retained against boss 128 by a threaded sleeve 130. Threaded sleeve 130 may be threaded about one end of post 122, adjacent a second end of spring 126, and may be tightened or loosened to selectively adjust the calibration of the scale by adjusting the tension of the springs 124, 126, as desired. Scale 112 may also include a locking nut 132 to retain the treaded sleeve 130 against springs 124, 126 and to also retain an outer sleeve 133 over at least a portion of springs 124, 126. In the present embodiment, a first end of outer sleeve 133 may be supported on locking nut 132, and the outer sleeve may otherwise be unrestrained so as to preferably "float" over springs 124, 126. Outer sleeve 133 may preferably include a projection 136 extending from a second end thereof, such as a disc, which is configured to contact a first end of pointer 138 which may ride along the surface of the disc. Pointer 138 preferably includes a second end which may be configured as an arrow 139 visible through slot 140 and which may be pivotally connected to frame 118, as described above. In use, as an article of clothing is placed on frame 118, the weight of the article of clothing moves the frame 118 downward, in the direction of arrow A, against the force of the compression springs 124, 126. As the frame 118 moves downward and the springs 124, 126 are compressed, pointer 138 is pivoted about point 142 in the direction of arrow C. As the pointer is pivoted, arrow 139 moves within slot 140, as described above, to provide the viewer with a visual indication relating to the weight of the clothing.

It will be understood that various modifications may be made to the embodiment disclosed herein. For example, the slot may be disposed anywhere on the hanger, such as on the top or side of the display plate. Also, any form of indicia may be utilized, such as words, colors, graphics and the like. Finally, the hanger may be configured to hold various types of clothing and the scale may be any of a variety of weighing mechanisms and is, therefore, not limited to the scales described herein. Therefore, the above description should not be construed as limiting, but merely as exemplifications of a preferred embodiment. Those skilled in the art will envision other modifications within the scope spirit of the invention.

I claim:

1. An apparatus for displaying information related to the weight of an article of clothing, comprising:

a hanger-shaped frame constructed and arranged to retain the article of clothing over the hanger-shaped frame;

a scale for measuring the weight of the article of clothing retained by said hanger-shaped frame;

wherein said hanger-shaped frame is moveable relative to said scale in response to an article of clothing being placed on said hanger-shaped frame, causing said scale to provide information related to the weight of the article.

2. The apparatus of claim 1, further comprising a hanging means for supporting said hanger-shaped frame.

3. The apparatus of claim 2, wherein said hanging means is an open hook.

4. The apparatus of claim 2, wherein said hanging means is a pedestal.

5. The apparatus of claim 1, wherein said frame is configured as a housing and said scale is disposed within said housing.

6. The apparatus of claim 1, further comprising a visual indicator to display the information related to the weight of the clothing to a viewer.

7. The apparatus of claim 6, wherein said visual indicator includes a pointer operatively associated with said scale such that movement of said frame relative to said scale moves said pointer between a first position and a second position.

8. The apparatus of claim 7, wherein said pointer is visible through a slot disposed in said frame.

9. The apparatus of claim 8, wherein said visual indicator further includes indicia to provide the viewer with visual information relating to the weight of the article of clothing as said pointer moves.

10. The apparatus of claim 9, wherein said indicia includes a first region associated with a predetermined range of light-weightedness of the article of clothing.

11. An apparatus for displaying information related to the weight of an article of clothing, comprising:

a hanger-shaped frame constructed and arranged to support the article of clothing;

a scale for measuring the weight of the article of clothing supported by said hanger-shaped frame;

wherein said hanger-shaped frame is moveable relative to said scale in response to an article of clothing being placed on said hanger-shaped frame, causing said scale to provide information related to the weight of the article; and wherein said scale includes a rod engageable at a first end with said frame, at least one spring disposed about said rod, an adjustable sleeve secured at a second end of said rod and constructed and arranged to retain said at least one spring about said rod, and a lock nut for retaining a first end of a wire between said adjustable sleeve and said lock nut.

12. The apparatus of claim 11, wherein a second end of said wire engages a pointer operatively associated with said scale such that movement of said frame relative to said scale moves said pointer between a first position and a second position to provide the viewer with visual information relating to the weight of the article of clothing.

13. The apparatus of claim 1, wherein said frame includes a first arm and a second arm constructed and arranged to hold the article of clothing.

14. The apparatus of claim 1, wherein said frame includes a rod constructed and arranged to hold the article of clothing.

15. The apparatus of claim 1, wherein said frame includes at least one clip to hold the article of clothing.

16. An apparatus for displaying information related to the weight of an article of clothing, comprising:

a hanger-shaped frame constructed and arranged to retain the article of clothing over the hanger-shaped frame;

a scale for measuring the weight of the article of clothing retained by said hanger-shaped frame;

indicia associated with said scale including a first region associated with a predetermined range of light-weightedness of the article of clothing.

17. The apparatus of claim 16, wherein said indicia includes graphics related to the light-weightedness of the article of clothing.

18. The apparatus of claim 16, wherein said indicia includes text related to the light-weightedness of the article of clothing.

19. The apparatus of claim 16, wherein said frame is moveable relative to said scale in response to an article of clothing being placed thereon.

20. The apparatus of claim 19, further comprising a pointer operatively associated with said scale such that movement of said frame relative to said scale moves said pointer between a first position and a second position to provide the viewer with visual information relating to the light-weightedness of the article of clothing.

21. An apparatus for displaying information related to the weight of an article of clothing, comprising:

hanger-shaped frame means for supporting the article of clothing;

hanging means for supporting said hanger-shaped frame means;

a scale for measuring the weight of the article of clothing supported by said hanger-shaped frame means;

wherein said hanger-shaped frame means is moveable relative to said scale in response to an article of clothing being placed on said hanger-shaped frame means, causing said scale to provide information related to the weight of the article.

22. An apparatus for displaying information related to the weight of an article of clothing, comprising:

a hanger-shaped frame constructed and arranged to support the article of clothing;

an open hook for supporting said hanger-shaped frame;

a scale for measuring the weight of the article of clothing supported by said hanger-shaped frame;

wherein said hanger-shaped frame is moveable relative to said scale in response to an article of clothing being placed on said hanger-shaped frame, causing said scale to provide information related to the weight of the article.

23. The apparatus of claim 22, wherein the hanger-shaped frame includes an arm constructed and arranged to retain the article of clothing over the frame.

24. The apparatus of claim 22, wherein the hanger-shaped frame includes a rod constructed and arranged to retain the article of clothing.

25. A clothes hanger, comprising:

a clothes hanger shaped frame including an arm constructed and arranged to support an article of clothing;

a hook for supporting said clothes hanger-shaped frame;

a scale interposed between the clothes hanger-shaped frame and the hook to register the weight of the article of clothing supported by the clothes hanger-shaped frame.

26. The clothes hanger of claim 25, wherein the hook is an open hook.

* * * * *